US007942402B2

(12) United States Patent
Forche et al.

(10) Patent No.: US 7,942,402 B2
(45) Date of Patent: May 17, 2011

(54) METHOD FOR FEEDING SHEETS TO A SHEET PROCESSING MACHINE

(75) Inventors: Jens Forche, Freinsheim (DE); Christian Hieb, Neuhofen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 486 days.

(21) Appl. No.: 11/962,424

(22) Filed: Dec. 21, 2007

(65) Prior Publication Data

US 2008/0164649 A1 Jul. 10, 2008

(30) Foreign Application Priority Data

Dec. 21, 2006 (DE) ..... 10 2006 060 661

(51) Int. Cl.
*B65H 3/46* (2006.01)
*B65H 29/68* (2006.01)

(52) U.S. Cl. ..... 271/105; 271/183

(58) Field of Classification Search ..... 271/183, 271/275–277, 105, 182
See application file for complete search history.

(56) References Cited

U.S. PATENT DOCUMENTS

| | | | | |
|---|---|---|---|---|
| 4,060,236 | A * | 11/1977 | Carstedt | 271/183 |
| 4,119,309 | A * | 10/1978 | Mayer et al. | 271/183 |
| 4,355,800 | A * | 10/1982 | Sugiyama | 271/229 |
| 4,613,125 | A * | 9/1986 | Jeschke | 271/227 |
| 5,150,131 | A * | 9/1992 | Le Jaoudour | 346/134 |
| 5,636,833 | A * | 6/1997 | Maier et al. | 271/276 |
| 6,254,092 | B1 * | 7/2001 | Yraceburu et al. | 271/276 |
| 6,626,109 | B2 * | 9/2003 | Kundgen et al. | 101/477 |
| 6,663,550 | B2 * | 12/2003 | Frankenberger et al. | 493/256 |
| 6,682,066 | B2 * | 1/2004 | Gunschera et al. | 271/183 |
| 6,702,283 | B2 * | 3/2004 | Berlingen et al. | 271/276 |
| 6,729,615 | B2 * | 5/2004 | Luongo et al. | 271/188 |
| 7,156,390 | B2 * | 1/2007 | Eitel et al. | 271/245 |
| 7,261,292 | B2 * | 8/2007 | Butterfass et al. | 271/245 |
| 7,584,957 | B2 * | 9/2009 | Edinger | 271/197 |
| 2002/0158410 | A1 * | 10/2002 | Dolz et al. | 271/276 |

FOREIGN PATENT DOCUMENTS

| | | | |
|---|---|---|---|
| DE | 4426991 | A1 | 2/1996 |
| DE | 19753137 | C1 | 10/1998 |
| DE | 19733692 | A1 | 2/1999 |
| DE | 10212273 | A1 | 10/2002 |
| DE | 102004012697 | A1 | 10/2004 |
| JP | 11-227159 | A | 8/1999 |

* cited by examiner

*Primary Examiner* — Stefanos Karmis
*Assistant Examiner* — Patrick Cicchino
(74) *Attorney, Agent, or Firm* — Laurence A. Greenberg; Werner H. Stemer; Ralph E. Locher

(57) ABSTRACT

An apparatus for feeding sheets to a sheet processing machine smoothes out and fixes a sheet through the use of a suction groove disposed transversely relative to a sheet transport direction, before the sheet is gripped by an onward transport device. A sheet-fed rotary printing press having the apparatus is also provided.

1 Claim, 4 Drawing Sheets

METHOD FOR FEEDING SHEETS TO A SHEET PROCESSING MACHINE

CROSS-REFERENCE TO RELATED APPLICATION

This application claims the priority, under 35 U.S.C. §119, of German Patent Application DE 10 2006 060 661.2, filed Dec. 21, 2006; the prior application is herewith incorporated by reference in its entirety.

BACKGROUND OF THE INVENTION

Field of the Invention

The invention relates to a method for feeding sheets to a sheet processing machine, in which sheets to be transported through the use of gripper devices are smoothed out before a gripper closure, in order to ensure that they lie flat on a feed table and can be gripped by transport grippers, e.g. pre-grippers, without corrugating.

German Patent DE 197 53 137 C1, corresponding to patent Abstracts of Japan 11227159 A, shows an apparatus having a row of blowing and sucking nozzles, to which blown air can be applied. The nozzles are disposed transversely with respect to the sheet transport direction and spaced apart from one another by insert elements. In that way, blown air is blown under the sheets at a shallow angle and is intended to produce a suction effect.

German Published, Non-Prosecuted Patent Application DE 10 2004 012 697 A1, corresponding to U.S. Pat. No. 7,261,292, shows an apparatus having a number of suction openings disposed spaced apart from one another in a row transversely with respect to the sheet transport direction. Suction air can be successively applied to the suction openings cyclically by a rotary valve or electromagnetically controllable valves, in order to spread out and smooth a sheet laterally.

As a result of the suction-free region between two suction openings, because of the mass moment of inertia of a sheet in conjunction with the rapid application of suction air, it is possible for the sheet to not lie smoothly in the region between two suction openings. Therefore, a slight corrugation of the sheet is produced transversely with respect to the sheet transport direction.

SUMMARY OF THE INVENTION

It is accordingly an object of the invention to provide a method for feeding sheets to a sheet processing machine, which overcomes the hereinafore-mentioned disadvantages of the heretofore-known methods of this general type and which smoothes the sheets with great reliability.

With the foregoing and other objects in view there is provided, in accordance with the invention, an apparatus for feeding sheets to a sheet processing machine. The apparatus comprises a feed table, and a pneumatic device disposed in the feed table for smoothing out the sheets. The pneumatic device includes a groove for receiving suction air. The groove extends over a maximum sheet width to be processed.

It is an advantage of the invention that the sheet smoothing apparatus is constructed as a groove. Seamless smoothing out or flattening of the sheet can be carried out through the use of this measure.

The formation of the sheet smoothing apparatus as a groove is simple and can be carried out inexpensively.

Different insert pieces can be used for the purpose of an individual configuration of the groove opening.

It is also proposed to provide the groove with a thin-walled grill, if appropriate, in order to eliminate catch points for the sheet. A further possible way of avoiding catch points on the groove is preferably achieved through the use of a run-on bevel.

The groove has a length which corresponds at least to the maximum sheet format to be processed. In the case of smaller formats, because of the small width of the groove, infiltrated air has no detrimental influence on the retaining force and therefore on the functionality of the suction groove.

A plurality of grooves can also be provided at a short distance from one another in the sheet transport direction, in order to increase the suction force.

With the objects of the invention in view, there is concomitantly provided a sheet-fed rotary printing press, comprising an apparatus according to the invention.

Other features which are considered as characteristic for the invention are set forth in the appended claims.

Although the invention is illustrated and described herein as embodied in a method for feeding sheets to a sheet processing machine it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
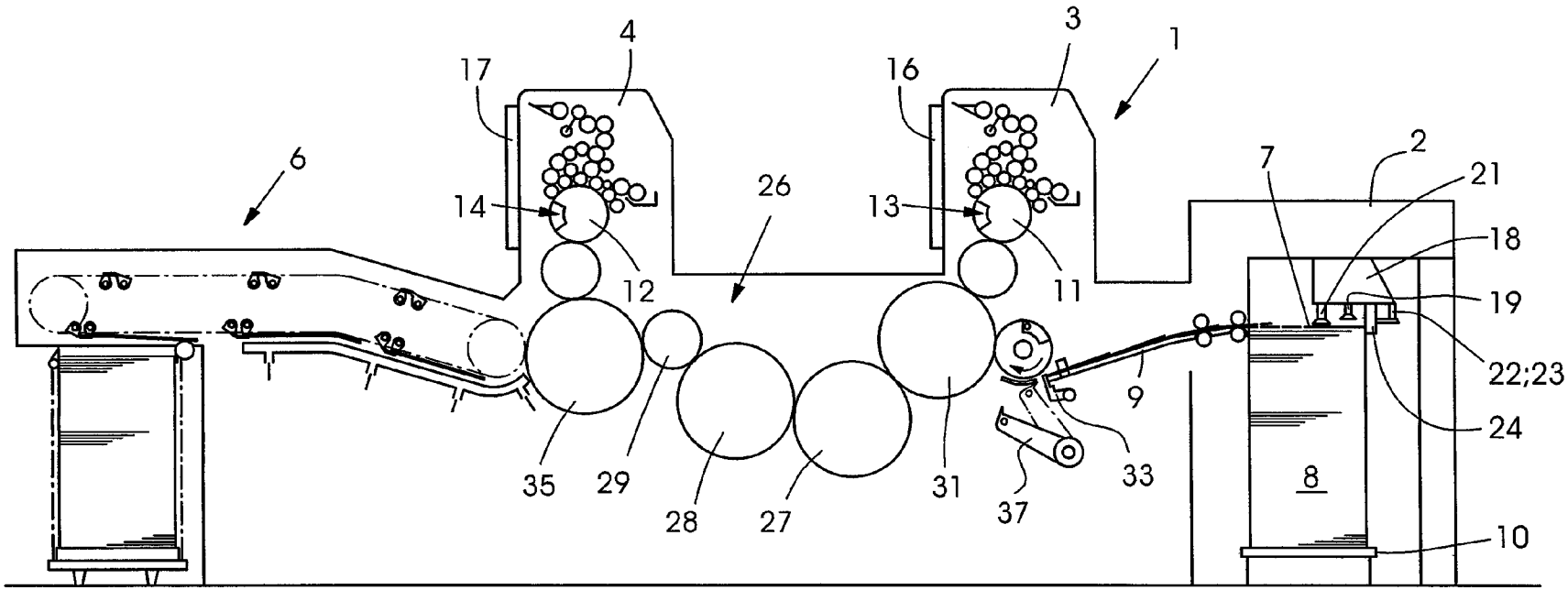
FIG. 1 is a diagrammatic, longitudinal-sectional view of a sheet-fed rotary printing press.

Referring now to the figures of the drawings in detail and first, particularly, to FIG. 1 thereof, there is seen a machine for processing sheets 7, e.g. a printing press 1, which has a feeder 2, at least one printing unit 3, 4 and a delivery 6. The sheets 7 are removed from a sheet stack 8 and are fed, in a separated or in overlapping formation, to the printing units 3, 4 over a feed table 9. The printing units 3, 4 each contain a plate cylinder 11, 12 in a known manner. The plate cylinders 11, 12 each have an apparatus 13, 14 for fixing flexible printing plates. Furthermore, each plate cylinder 11, 12 is assigned an apparatus 16, 17 for semi-automatic or automatic printing plate changing.

The sheet stack 8 lies on a stack board 10 which can be raised under control. The sheets 7 are removed from the top side of the sheet stack 8 through the use of a suction head 18, as it is known, which inter alia has a number of lifting and dragging suckers 19, 21 for separating the sheets 7. Furthermore, blowing devices 22 for loosening the upper sheet layers and sensing elements 23 for tracking the stack are provided. A number of side and rear stops 24 are provided in order to align the sheet stack 8, in particular the upper sheets 7 of the sheet stack 8.

A turning device 26 is disposed between two impression cylinders 31, 35 and has a transfer cylinder 27, a storage drum 28 and a turning drum 29.

Figure 2:
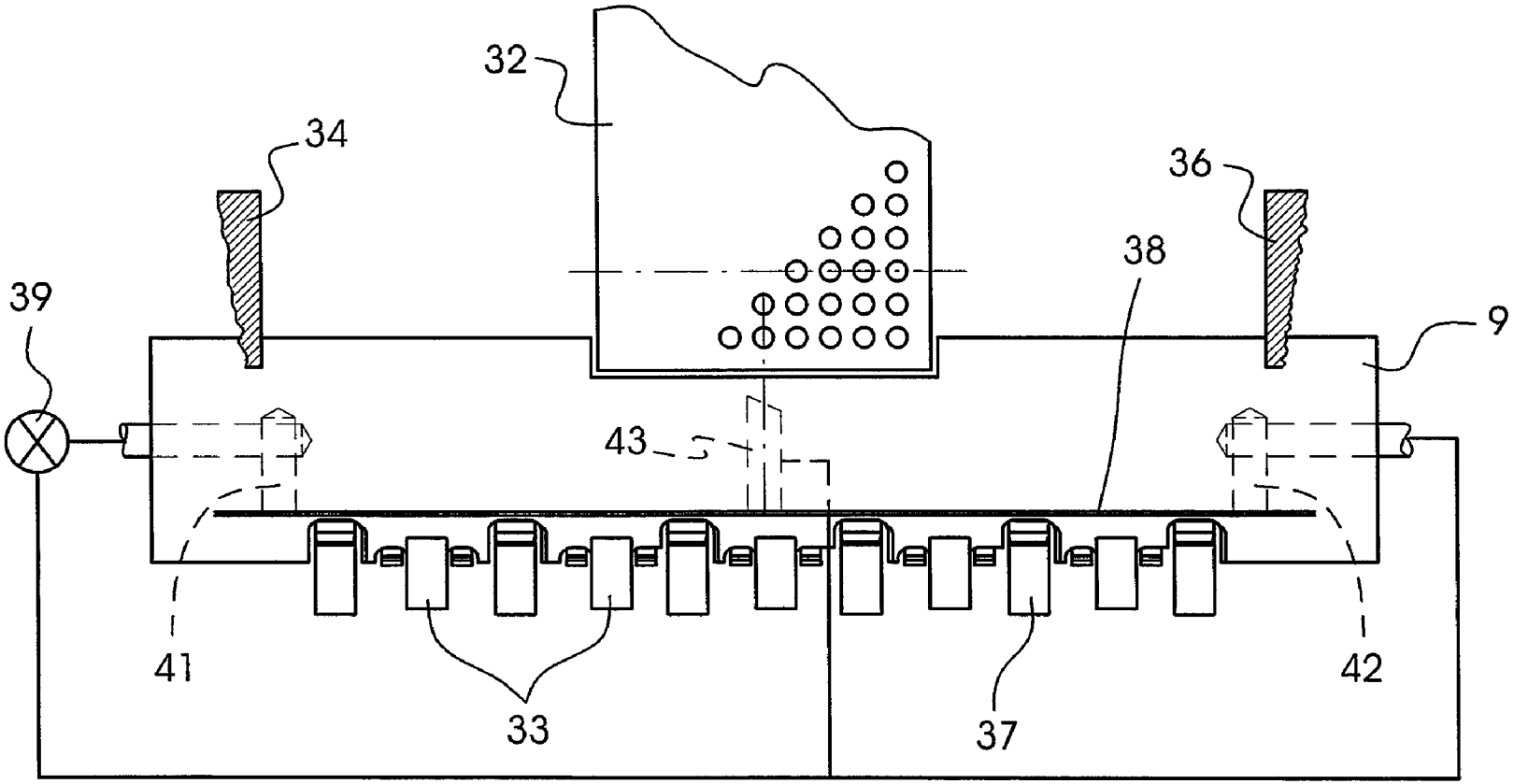
FIG. 2 is an enlarged, fragmentary, top-plan view of a feed table in a region of an onward transport device with the apparatus for sheet smoothing according to the invention.
Figure 2A:
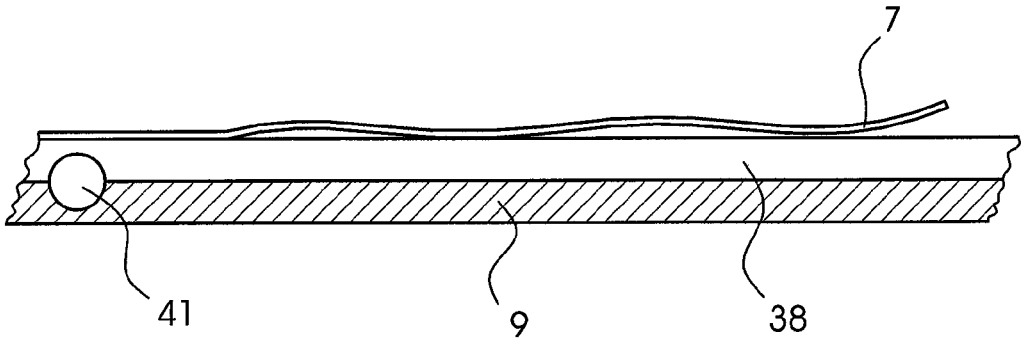
FIG. 2*a* is a further enlarged, fragmentary, longitudinal-sectional view of a groove of FIG. 2.

FIG. 2 shows the feed table 9 in a plan view. A sheet transport belt 32 formed as a suction belt conveys the sheets 7 in overlapping formation or individually to front guides or lays 33, in order to align the sheets in a sheet transport direction. Side stops 34 and 36 are used to align the sheets 7 optionally on the left or on the right transversely with respect to the sheet transport direction. Onward transport devices 37, for example in the form of pre-grippers, are disposed in a row alternately with the front guides or lays 33. A groove 38 is disposed transversely with respect to the sheet transport direction and is open at the top in the direction of the sheets, in a region between the transport belt 32 and the front guides or lays 33. The groove 38 extends sideways at least as far as a maximum format width of the sheets to be processed.

Figure 2B:
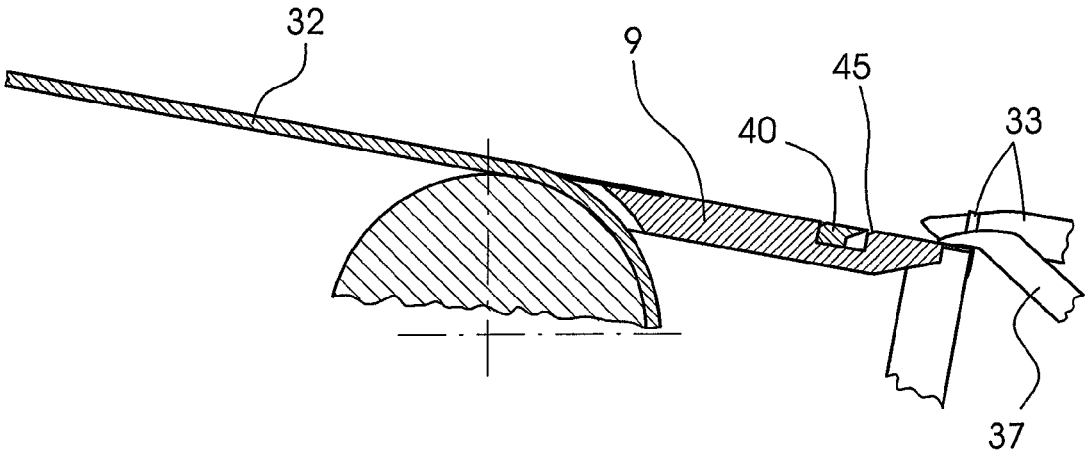
FIG. 2*b* is a fragmentary, longitudinal-sectional view of the feed table as illustrated in FIG. 2.

The groove 38 can have an insert piece 40, as is seen in FIG. 2*b*, so that it can be produced easily. Furthermore, the groove 38 has a run-on bevel 45, which avoids catching of the leading-edge of the sheet. If required, a thin-walled grill, having webs which are very narrow, can also be provided in order to cover the groove 38.

The groove 38 can have suction air or vacuum applied to it from a suction air source 39 at a cycle rate of the sheet processing machine. For this purpose, the groove 38 is provided with a first suction connection 41, which is disposed at the end of the groove 38. A second suction connection 42 can be disposed at the opposite end of the groove 38.

Depending on the desired pulling direction, either the first suction connection 41 or the second suction connection 42 can be activated, with the other respective connection being switched off. A third suction connection 43 can be disposed in the center of the groove 38. If the third suction connection 43 is activated, the other suction connections 41, 42 are switched off.

A sheet 7 is firstly transported as far as the front guides or lays 33 through the use of the transport belt 32 and is aligned there in the circumferential direction or sheet transport direction. The sheet 7 is then aligned sideways against a side stop 34 or 36 through the use of a non-illustrated side pulling apparatus. Depending on the pulling direction, the suction connection 41 is then activated if the sheet is to be aligned against the connection 34 disposed on the right in the sheet transport direction. Through the use of this measure, the sheet 7 is firstly attracted by suction in the region of the stop 34. The suction force on the underside of the sheet is propagated swiftly and continuously along the groove 38 and in this case smoothes the sheet 7.

The sheet 7 is now fixed in the region of its front edge, before the pre-grippers 37 transport it further in the grip of the grippers to the sheet processing machine. An alignment against the stop 36 disposed on the left in the sheet transport direction is carried out in a manner analogous to that described previously.

The third suction connection 43 is provided and activated if the sheet 7 is to be smoothed simultaneously towards both sides as seen from the center. In this case, lateral alignment before the gripper closure can be dispensed with. This is carried out for the first time in the grip of the grippers during the sheet transport, for example by the pre-grippers 37.

Figure 3:
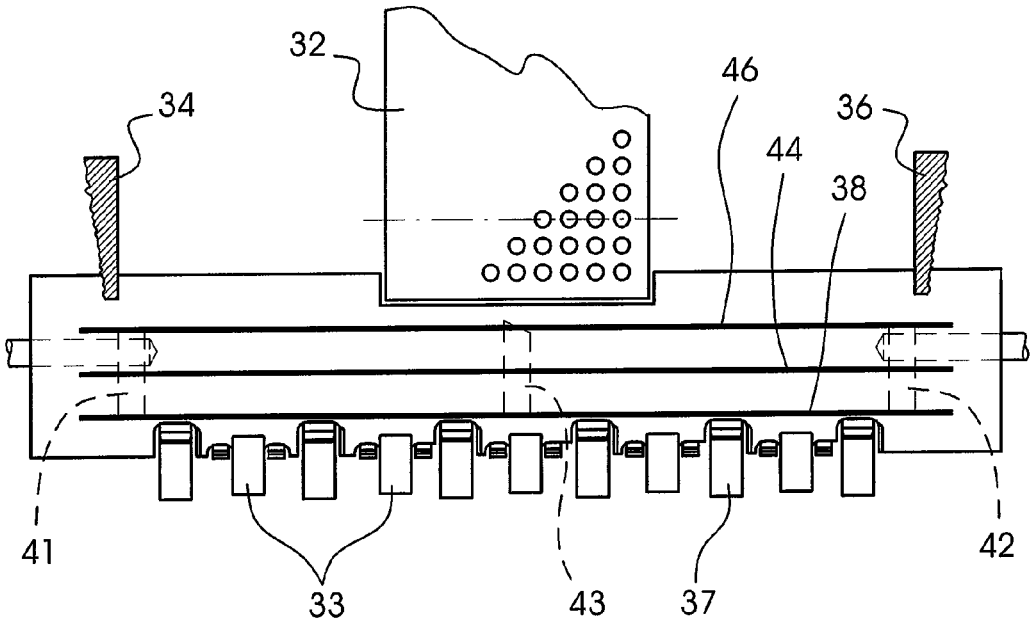
FIG. 3 is a view similar to FIG. 1 of a second exemplary embodiment having two suction grooves disposed in parallel.

According to the embodiment of FIG. 3, two or more suction grooves 38, 44, 46 can be provided in order to increase the suction force on the sheet. The grooves 44, 46 extend parallel to the first suction groove 38 and thus transversely relative to the sheet transport direction. The suction connections 41, 42, 43 supply all of the suction grooves 38, 44, 46 in this case.

Figure 4:
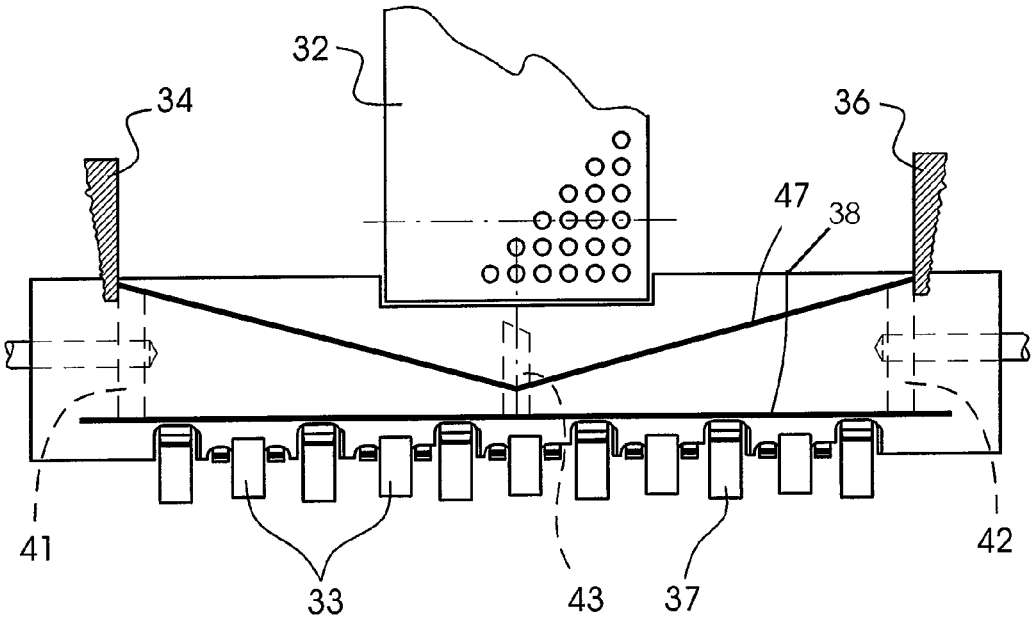
FIG. 4 is a view similar to FIGS. 1 and 3 of a third exemplary embodiment having a first groove running transversely with respect to a sheet transport direction and a second groove disposed in the shape of a V in the sheet transport direction.

In a further exemplary embodiment according to FIG. 4, provision is made for a V-shaped groove 47, having a tip or point which points in the sheet transport direction, to be disposed before the suction groove 38 as seen in the sheet transport direction.

In particular, in the event of activation of the central suction connection 43, the sheet 7 is not only smoothed sideways but also obliquely rearward. This results in very good fixing of the sheet 7 before it is taken over by the pre-grippers 37. Following the closure of the grippers, the suction air is switched off. If required, venting of the groove 38 and of the other grooves 44; 46; 47, can also be provided.

The invention claimed is:

1. A method for feeding sheets to a sheet-processing machine, the method comprising the following steps:

providing a feed table for sheets to be transported in a sheet transport direction;

providing the feed table with a groove formed therein transversely to the sheet transport direction for smoothing out the sheets with suction air applied to the groove;

initially aligning a sheet in a sheet transport direction;

subsequently aligning the sheet in a lateral direction with a lateral alignment stop; and subsequently applying suction air to the sheet aligned in the sheet transport direction and in lateral direction by applying the suction air to the groove and to an underside of the sheet starting from the lateral alignment stop and extending toward an opposite side.

* * * * *